United States Patent [19]

Foust

[11] 3,954,000

[45] May 4, 1976

[54] BENDING TOOL FOR SEMI-RIGID COAXIAL CABLE

[75] Inventor: Orel Billy Foust, Richardson, Tex.

[73] Assignee: The United States of America as represented by the Secretary of the Navy, Washington, D.C.

[22] Filed: July 29, 1975

[21] Appl. No.: 600,017

[52] U.S. Cl. ..... 72/457; 72/32; 72/476

[51] Int. Cl.[2] ..... B21D 11/00

[58] Field of Search ..... 72/457, 476, 477, 462, 72/459, 32, 34, 35, 36

[56] References Cited

UNITED STATES PATENTS

| | | | |
|---|---|---|---|
| 882,012 | 3/1903 | Morris | 72/457 |
| 1,672,068 | 6/1928 | Laing | 72/457 |
| 1,761,798 | 6/1930 | Potter | 72/459 |
| 2,403,323 | 7/1946 | Adreon | 72/32 |
| 3,487,676 | 1/1970 | Guilbert | 72/477 |
| 3,563,078 | 2/1971 | Mastalski | 72/459 |

*Primary Examiner*—C. W. Lanham
*Assistant Examiner*—Gene P. Crosby
*Attorney, Agent, or Firm*—R. Sciascia; R. Beers; S. Scheinbein

[57] ABSTRACT

A cable-bending tool comprising a removable, cylindrical mandrel with a grooved circumference, an adjustable clamp positioned adjacent to the grooved circumference of the mandrel and forming therewith a cable-holding vice, a compass with suitable angle markings thereon installed below the mandrel and positioned so that when a cable is bent around mandrel circumference, the bend-angle may be determined from the angle markings, and a suitable pedestal mount for mounting the foregoing assembly thereon.

8 Claims, 2 Drawing Figures

BENDING TOOL FOR SEMI-RIGID COAXIAL CABLE

BACKGROUND OF THE INVENTION

1. Field of Invention

The present invention relates generally to semi-rigid tube-bending tools and more particularly to a tool for bending semi-rigid coaxial cables.

2. Background of the Invention

The increased use of higher frequencies in microwave equipment, coupled with denser packaging, have led to a greater utilization of solid-jacketed R.F. cables referred to as semi-rigid. For example, 97 unique semi-rigid cable assemblies are used in the AN/APS-116 Radar and its associated Ground Support Equipment. Fabrication of such semi-rigid cable assemblies must be carefully performed and each assembly must, in general, be treated as a microwave component assembly due to the increased assembly sensitivity to flaws and irregularities at the higher frequency levels of the microwave band. In order to prevent such flaws and irregularities, specialized tools and techniques are required to properly fabricate the semi-rigid cable assembly.

A major step in the fabrication of a particular semi-rigid cable assembly is the forming or bending of the raw stock (which is normally straight) into the desired shaped of configuration. This is necessary to assure proper installation into the applicable equipment. Semi-rigid cable has an outer jacket (conductor) and a center conductor, separated by a Teflon-type dielectric. In exacting applications, the distance between the inner and outer conductors must remain the same, and deformation of the outer jacket (conductor) is not permitted. During the forming or bending operation, the cable must be supported and the bend made preferably in a single motion to prevent wrinkles and deformation of the outer jacket. After the bend has been completed, it is not advisable to rebend the cable.

The required bending operation has in the past been performed with the T-1107 and T-2101 bending tools manufactured by Omni Spectra, Incorporated. But, these tools are limited to use with two cable diameters (i.e., 0.141 and 0.085 inches). The tools provide for only two bend radii for each cable diameter. No means are provided for determining the number of degress of bend. The use of these tools requires extensive operator training and results in trial-and-error fabrication methods. These tools will not perform all of the required bending operations.

Other devices have been developed for specialized bending applications. In some instances common tubular stock has been used for bending mandrels. But, the use of these various tools results in specialized techniques, operator training, and the absence of standardized fabrication procedures.

SUMMARY OF THE INVENTION

The present invention provides a bending tool without the previously discussed limitations of the prior art. This bending tool comprises a removable mandrel with a grooved outer circumference and with an adjustable clamp positioned adjacent to one portion of the outer grooved circumference to form a cable-holding vice; a removable compass installed under the mandrel and positioned so that a cable may be bent around the mandrel to a desired angle; and, a base and pedistal for mounting the assembly of the mandrel, the adjustable clamp, and the compass above the working surface area.

OBJECTS OF THE INVENTION

An object of the present invention is to standardize cable and pipe bending techniques.

Another object of the present invention is to bend a cable around a mandrel in a single motion without frequent trial-and-error bends.

A further object is to provide a bending tool which can bend a cable at more than one point between its ends and is more than one direction or plane.

A still further object is to provide a bending tool which lightly but firmly engages the cable to be bent, thus avoiding injury to the composite cable.

Yet another object is to provide a highly versatile bending tool which may be used with a variety of cable diameters and gives an exact bend-angle measurement without removal of the cable therefrom.

Other objects, advantages, and novel features of the present invention will become apparent from the following detailed description of the invention when considered in conjunction with the accompanying drawings.

DETAILED DESCRIPTION OF THE INVENTION

Figure 1:
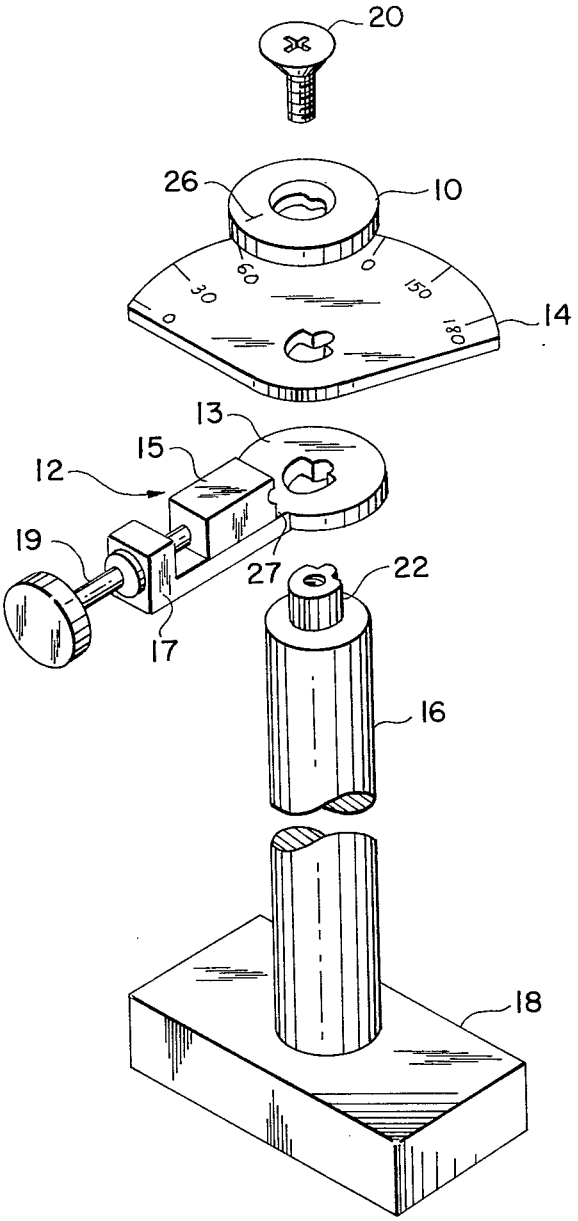
FIG. 1 is an exploded perspective view of the cable-bending tool of the present invention.
Figure 2:
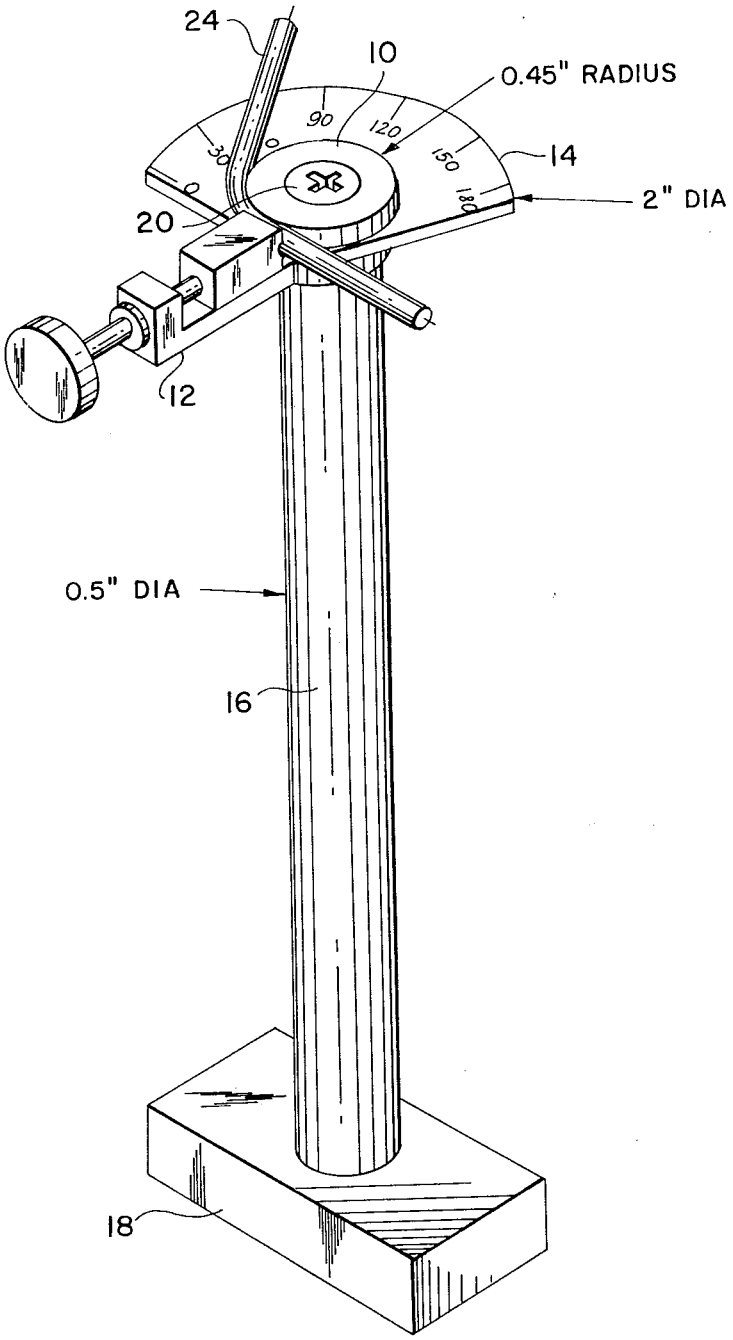
FIG. 2 is a perspective view of the cable-bending tool of the present invention with a cable grasped therein.

FIGS. 1 and 2 show the bending tool of the present invention. An assembly comprising a cylindrical disk-shaped mandrel 10, an adjustable clamp 12, and a flat compass plate 14 are mounted on the top of a pedestal 16 by way of a rotation-preventing key 22 protruding from the top of the pedestal 16. The pedestal is, in turn, mounted on a solid base 18. A screw or similar device 20 secures the mandrel 10, the compass 14, and the base 13 of the clamp firmly to the top of the pedestal 16 by way of a threaded hole in the protruding key 22.

The mandrel 10 is fabricated to have a grooved outer circumference. The radius of the groove is chosen to match that of the cable to be bent. Positioned adjacent to a portion of this grooved circumference is an adjustable clamping device 12 comprising a clamp 15 set on a flat, oblong clamp base 13. The outer end 17 of the clamp base bends upward for a predetermined distance and has a threaded hole therethrough. The rod 19 protruding from the clamp 15 is threaded along a portion of its length and is screwed through the threaded hole in the upwardly projecting end 17. The clamp 15 is grooved at its end to support the cable 24 (FIG. 2). The construction of the clamping device 12 (i.e., the threaded rod 19 screwed through the threaded hole in the upward protruding end 17 of the clamp base 13) allows the grooved face of the clamp 15 to be tightened to form, in conjunction with the grooved circumference of the mandrel 10, a vice around the cable or pipe 24 to be bent.

If the opposed grooves in the mandrel 10 and the clamp 15 are made deep enough, then the opposed spaced pairs of ridges 25 and 27 on either side of the opposed grooves will be drawn into positive abutting engagement as the clamping device is tightened over the cable 24. This abutting engagement insures that the cable 24 is only lightly engaged by the clamp 15 and the mandrel 10 so that a precise bend may be obtained, but without injury to the composite cable (comprising the copper core, outer copper tube, and the epoxy liner or tube between the core and the copper tube).

Due to the simple method of securing the assembly together via the key 22 and the screw 20 the mandrel is easily removable. This easily removability allows the radius of the cable or pipe to be bent to be matched with a mandrel with a suitable radius. An index mark 26 may be placed on the top of the mandrel to indicate where the cable or pipe will bend.

A removable compass 14 is installed under the mandrel 10. The compass is suitably marked in degrees. This permits the cable to be bent by tracking it through the groove around the mandrel 10 to the desired number of degrees of bend. Thus, the bend may be made in a single bending motion to the desired bend-angle without the previously required multiple trial-and-error bends. For best results, the mandrel and the compass should be removed and mounted in pairs for the various bend radii.

The pedestal 16 is used to mount the mandrel, clamping device, and copass. It is designed to elevate the working stock (cable) above the working surface (bench, etc.) away from obstacles. The pedestal permits the operator better visual and manual access to his work. The pedestal also permits the operator to make bends at various angles from each other which is not always possible when working directly from the work surface or bench. The pedestal, as previously mentioned, incorporates a pin or keying device 22 to assure proper alignment of the mandrel, clamping device, and compass and to prevent them from rotating. The screw 20 secures this assembly to the pedestal 16.

The pedestal 16 is mounted on a base 18. The base is designed to be held in a common vice, normally found on a typical work-bench. A base which clamps to the edge of a work surface could, of course, be designed. However, bench vices are normally available in most mechanical work areas. The small base permits the tool to be positioned at various angles from the vertical (in a vice) at the operator's discretion. It also simplifies the design.

The semi-rigid bending tool is portable, easy to store when not in use and simple to operate. It provides the maximum of bending capability with the minimum of tools and equipment. This tool also permits a given length of cable to be bent at more than one point between its ends and in more than one direction or plane. Hence, it might be classified as a universal bending tool. Although the present design has been discussed mainly in the context of a semi-rigid coaxial cable, it could be utilized to bend a variety of tubular devices such as, for example, small diameter copper and aluminum tubing and wire.

Obviously, many modifications and variations of the present invention are possible in light of the above teachings. It is therefore to be understood that, within the scope of the appended claims, the invention may be practiced otherwise than as specifically described.

What is claimed is:

1. A cable and pipe bending tool comprising:

mandrel means with a grooved outer circumference for bending semi-rigid cable and pipe along the track of said grooved circumference;

adjustable clamp means positioned adjacent to one portion of said outer grooved circumference, said clamp means combining with said portion of adjacent grooved circumference to form a cable and pipe holding vice;

compass means with markings thereon for determining bend angles, said compass means being installed adjacent said mandrel means and positioned so that when a cable or pipe gripped by said vice and bent around said mandrel means the bend-angle may be determined from said markings; and mounting means for mounting the assembly of said mandrel means, said adjustable clamp means, and said compass means.

2. A cable and pipe bending tool as defined in claim 1, wherein said mandrel means is cylindrical in shape.

3. A cable and pipe bending tool as defined in claim 1, wherein said mounting means comprises:

key means for attaching said mandrel means and said compass means to said mounting means in a manner such that they are easily removable while preventing rotation therebetween.

4. A cable and pipe bending tool as defined in claim 1, wherein said mounting means comprises:

base means;

pedestal means mounted on said base means; and attachment means attaching the assembly of said mandrel means, said compass means, and said clamp means to the top of said pedestal means in an easily removable manner.

5. A cable and pipe bending tool as defined in claim 1, wherein said compass means comprises a flat semicircular plate with angular marking spaced around its circumference.

6. A cable and pipe bending tool as defined in claim 1, wherein said clamp means comprises:

a flat oblong base with an upward protruding finger at one end with a threaded hole therethrough and with its other end adapted to fit on said mounting means; and a clamping block with a threaded rod projecting therefrom which is screwed through the threaded hole in the upward protruding finger of said flat base, said clamping block having a grooved face on the end opposite to the projecting threaded rod, said clamping block being suitably oriented on said flat base so that said grooved face, in conjunction with the grooved circumference of said mandrel means, form a vice for holding cables and pipes.

7. A semi-rigid coaxial-cable bending tool comprising:

removable, cylindrical disk means adapted for bending a cable therearound;

adjustable means for clamping a cable firmly against the outer cylindrical circumference of said disk means;

compass means with markings thereon for determining bend angles, said compass means removably located adjacent to said disk means and positioned so that when a cable is bent around said disk means, the bend-angle may be determined from said markings; and means for holding said disk means, clamp means and compass means in a predetermined orientation relative to one another.

8. A semi-rigid, cable-bending tool as defined in claim 7 wherein said holding means comprises:

base means;

pedestal means mounted on said base means; and attachment means attaching the assembly of said disk means, said compass means, and said clamping means to the top of said pedestal means in an easily removable manner.

* * * * *